US006408454B1

(12) United States Patent
Hyde

(10) Patent No.: US 6,408,454 B1
(45) Date of Patent: Jun. 25, 2002

(54) FOLDING WADING POOL AND METHOD FOR FOLDING A POOL

(76) Inventor: Earl Hyde, P.O. Box 56, New Vernon, NJ (US) 07976

( * ) Notice: Subject to any disclaimer, the term of this patent is extended or adjusted under 35 U.S.C. 154(b) by 0 days.

(21) Appl. No.: 09/902,891

(22) Filed: Jul. 13, 2001

(51) Int. Cl.[7] ..... E04H 4/00
(52) U.S. Cl. ..... 4/506; 4/585
(58) Field of Search ..... 4/506, 513, 585, 4/586; 52/169.7

(56) References Cited

U.S. PATENT DOCUMENTS

| | | | | |
|---|---|---|---|---|
| 991,246 A | | 5/1911 | Rosenfeld | |
| 1,128,211 A | | 2/1915 | Wohlwend | |
| 1,373,182 A | | 3/1921 | Fischer | |
| 2,236,060 A | | 3/1941 | Hyndman | 229/53 |
| 2,443,440 A | | 6/1948 | Alvarez | 4/177 |
| 2,505,845 A | | 5/1950 | Alvarez | 4/177 |
| 2,628,364 A | | 2/1953 | Wallace | 4/177 |
| 2,766,462 A | | 10/1956 | Norman | 4/172 |
| 2,839,762 A | * | 6/1958 | Ryutaro Nomura | 4/506 |
| 3,087,640 A | | 4/1963 | Blaser | 220/6 |
| 3,869,736 A | | 3/1975 | Valois | 4/172.19 |
| D245,524 S | | 8/1977 | Friedlander | D34/5 F |
| 4,811,437 A | * | 3/1989 | Dillner et al. | 5/99 B |
| 4,860,914 A | * | 8/1989 | Derni et al. | 4/506 X |
| 5,205,791 A | * | 4/1993 | Pledger | 4/506 X |
| 5,460,324 A | | 10/1995 | Vinther | 229/405 |
| 5,603,129 A | * | 2/1997 | Chon | 4/506 |

FOREIGN PATENT DOCUMENTS

| | | | | |
|---|---|---|---|---|
| GB | 148831 | * | 7/1920 | 4/585 |

* cited by examiner

*Primary Examiner*—Charles E. Phillips
(74) *Attorney, Agent, or Firm*—Thomas L. Adams

(57) ABSTRACT

A folding wading pool has in an unfolded condition a floor encompassed by an annular sidewall. The floor has a plurality of lower creases diverging outwardly from a central location toward the sidewall. The sidewall has a spaced plurality of upright creases. The lower and the upright creases can be folded to: (a) contract said sidewall by folding said upright creases, and (b) collapse said floor by (i) articulating said lower creases about said central location, and (ii) swinging said sidewall toward said floor.

29 Claims, 3 Drawing Sheets

FOLDING WADING POOL AND METHOD FOR FOLDING A POOL

BACKGROUND OF THE INVENTION

1. Field of the Invention

The present invention relates to wading pools, and methods for folding pools into a compact package.

2. Description of Related Art

A trip to the beach with children presents numerous challenges and requires many precautions. Young children must be carefully watched because of the risks associated with water. Moreover children may be adverse to cold ocean surf. Wading in ocean surf is inappropriate for small children and therefore safe diversions must be arranged. Because beach equipment is typically carried by hand, there are practical limitations to their size and weight.

While one can make a temporary play pool by pouring water into a hole dug in the sand, filling it with water with a typical beach pail is difficult. Regardless, the water eventually seeps through the sand. Portable play pools are known; for example, the pool of U.S. Pat. No. 2,505,845, which has inflatable sidewalls. See also U.S. Pat. No. 2,443,440. Inflating such a wall by blowing is difficult and time-consuming, especially in light of the short time the pool may be used at a beach.

The folding swimming pool of U.S. Des. Pat. No. 245,524 has a sidewall shown folded into twelve segments. Half of its inside face is brought against the opposite half and is then folded into six (doubled) sections. FIG. 4 shows that the folds of the sidewalls swing away from the floor to lie in the same plane as the folds of the floor. This ability to fold away from the floor, means the sidewall will not be stable when erected as shown in FIG. 1. Portions of the sidewall will be able to swing outwardly to a horizontal position and spill the water in the pool.

The pool of U.S. Pat. No. 2,766,462 has a flexible liner 12 supported on a frame. The frame can be folded with the liner as shown in FIG. 9. The frame is relatively complicated and has several rigid components. Thus this pool is relatively heavy and not easily transported. See also U.S. Pat. No. 2,628,364.

In U.S. Pat. No. 4,860,914 six pie-shaped segments are interlocked and held with fasteners to form a pool. This is a relatively complex structure and still uses a liner to stay watertight. Also, when collapsed, the pie-shaped segments do not lie flat, but each has a vertical and horizontal wall. See also U.S. Pat. No. 3,869,736.

In U.S. Pat. No. 991,246 paper can be folded to form a drinking cup. See also U.S. Pat. Nos. 1,128,211; 1,373,182; 2,236,060; 3,087,640; and 5,460,324.

Accordingly, there is a need for a portable pool that can be easily carried and assembled. While the foregoing suggest using a portable pool at ocean side, such utility will arise in other contexts. For example, a portable pool will be beneficial in a backyard, on a picnic, while traveling, while poolside, when visiting friends and relatives, on a patio or deck, etc.

SUMMARY OF THE INVENTION

In accordance with the illustrative embodiments demonstrating features and advantages of the present invention, there is provided a folding wading pool having in an unfolded condition a floor encompassed by an annular sidewall. The floor has a plurality of lower creases diverging outwardly from a central location toward the sidewall. The sidewall has a spaced plurality of upright creases. The lower and the upright creases are foldable to: (a) contract said sidewall by folding said upright creases, and (b) collapse said floor by (i) articulating said lower creases about said central location, and (ii) swinging said sidewall toward said floor.

In accordance with another aspect of the invention a method is provided for folding a wading pool. The pool, in an unfolded condition, has a floor encompassed by an annular sidewall. The method includes the step of folding the floor with a plurality of lower creases that diverge outwardly from a central location toward the sidewall. Another step is folding the sidewall with a spaced plurality of upright creases. The lower and the upright creases are folded to: (a) contract said sidewall by folding said upright creases, and (b) collapse said floor by (i) articulating said lower creases about said central location, and (ii) swinging said sidewall toward said floor.

By employing equipment and methods of the foregoing type, an improved, folding wading pool is achieved. In a preferred embodiment, a pool may be molded of elastomeric material in the shape of a short open cylinder. The floor and sidewall of the preferred pool may have a number of relieved creases formed by molding grooves in the pool. For example, a number of radial grooves may be molded on the floor with adjacent grooves placed on alternating sides of the floor. These radial grooves on the floor may intercept upright grooves on the sidewall, which may again be arranged in an alternating patterns.

This preferred pool may be folded by collapsing the floor in an umbrella-like fashion. Simultaneously, the sidewall may swing toward the floor while contracting in an accordion-like fashion. The pool will then be folded into a relatively small package that can be stored in a carrier. When the pool is in use, the empty carrier may serve as a water pail for filling the pool.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 2:
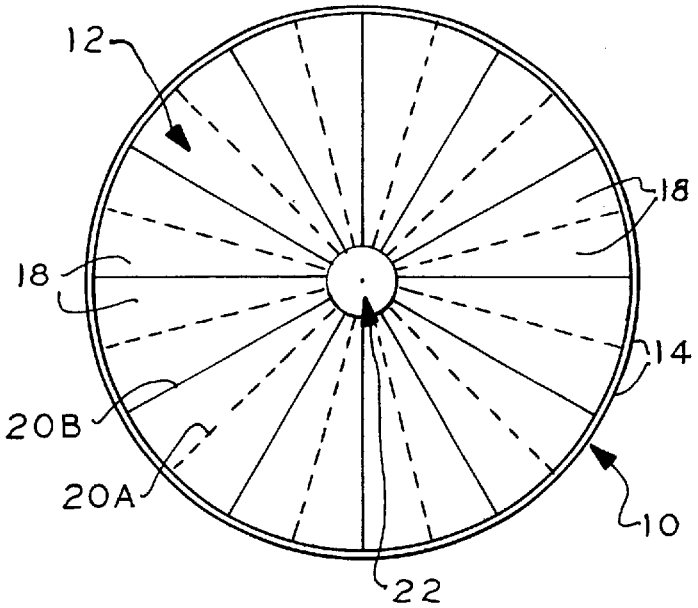
FIG. 2 is a top view of the pool of FIG. 1.
Figure 1:
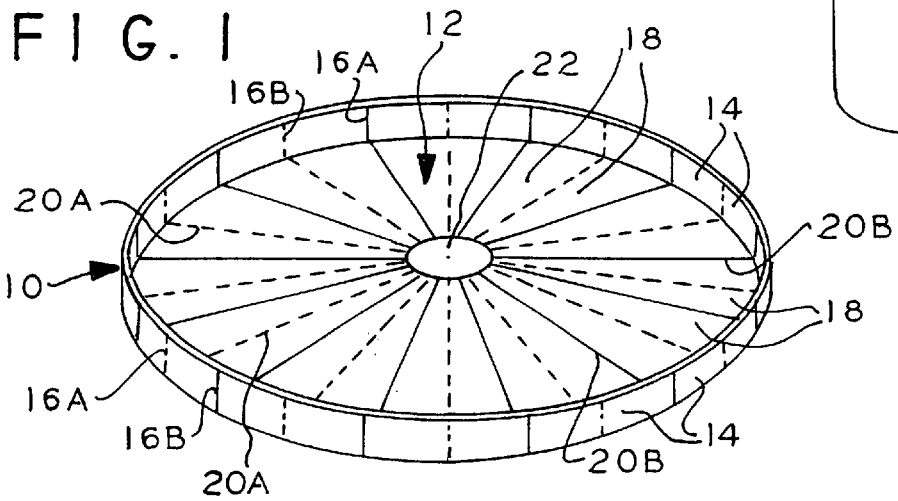
FIG. 1 is a perspective view of a folding wading pool in accordance with principles of the present invention.

Referring to FIGS. 1 and 2, a folding wading pool is shown with a cylindrical sidewall 10 joined perpendicularly to a circular floor 12. The sidewall 10 is composed of 24 four-sided segments 14. The segments 14 are preferably 12 to 16 cm tall, but may be sized differently in other embodiments. The segments 14 are joined together on the left and right by upright creases 16A and 16B to form a ring with a diameter of 75 to 250 cm, although other diameter sizes may be used in alternate embodiments.

Floor 12 is subdivided into 24 wedge-shaped, successive sectors 18. The outer edges of sectors 18 are integral with the lower edges of segments 14. The sectors 18 are joined together on their clockwise and counterclockwise edges by lower creases 20A and 20B. The sectors 18 converge toward a central location that is part of central region 22.

The sidewall 10 and floor 12 (including central region 22) may be integrally molded from an elastomeric material. This material will be chosen to have a sufficient rigidity to remain erect in the illustrated configuration, but without being brittle or presenting hard surfaces or sharp edges that may lead to injury. In some embodiments the pool material may be a composite with a relatively stiff core surrounded by a softer layer. In some instances portions of the pool may be fabricated as separate components that are then assembled with appropriate fastening means (gluing, heat sealing, elongated clamps, or other fasteners). In some embodiments a number of core elements may be separately fabricated and then joined together by molding a common, continuous layer over the core elements.

Figure 3:
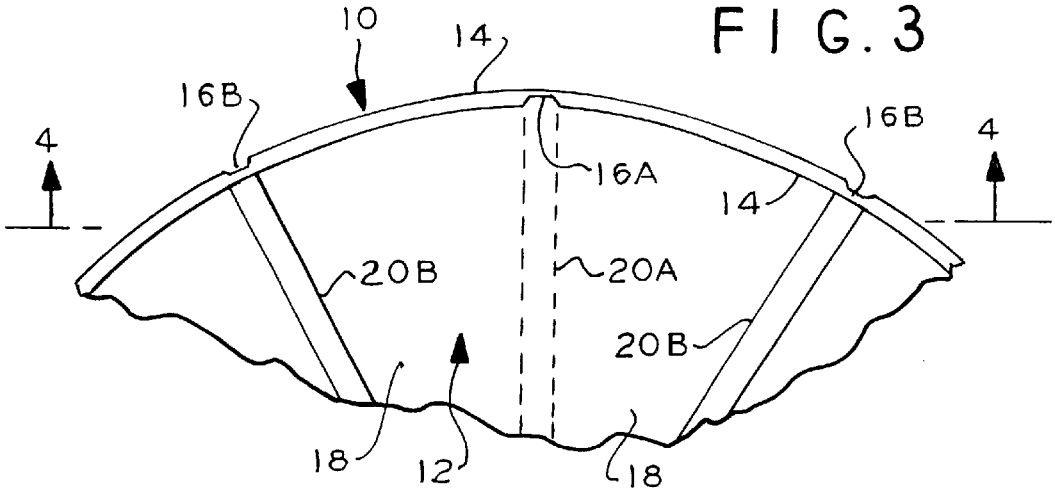
FIG. 3 is a detailed, fragmentary, top view of the pool of FIG. 2.
Figure 4:
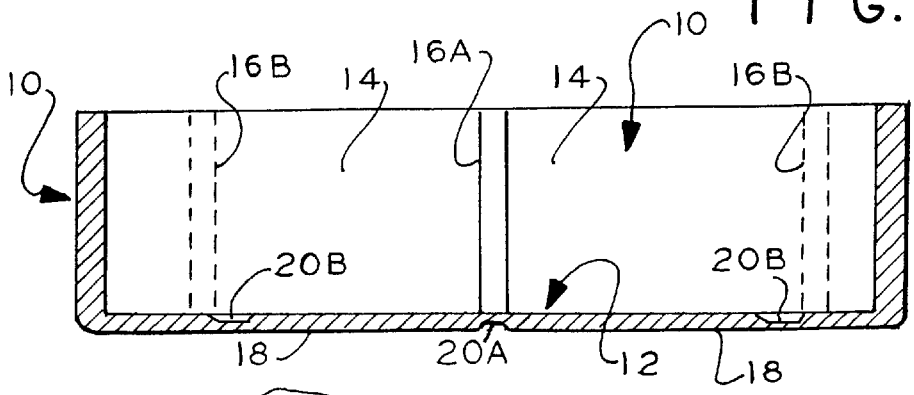
FIG. 4 is a cross-sectional, elevational view taken along line 4—4 of FIG. 3.

Referring to FIGS. 3 and 4, previously mentioned creases 20A and 20B are shown as radial grooves. Grooves 20A are formed on the underside of floor 12, while grooves 20B are formed on the topside. Grooves 20A and 20B are relieved to form a type of live hinge.

The previously mentioned upright creases are shown relieved by vertical grooves 16A and 16B. Grooves 16A and 16B are formed on the inside and outside, respectively, of sidewall 14. Grooves 16A and 20A are directed to the same location along the bottom edge of the pool. Grooves 16B and 20B also meet at the same locations.

Figure 5:
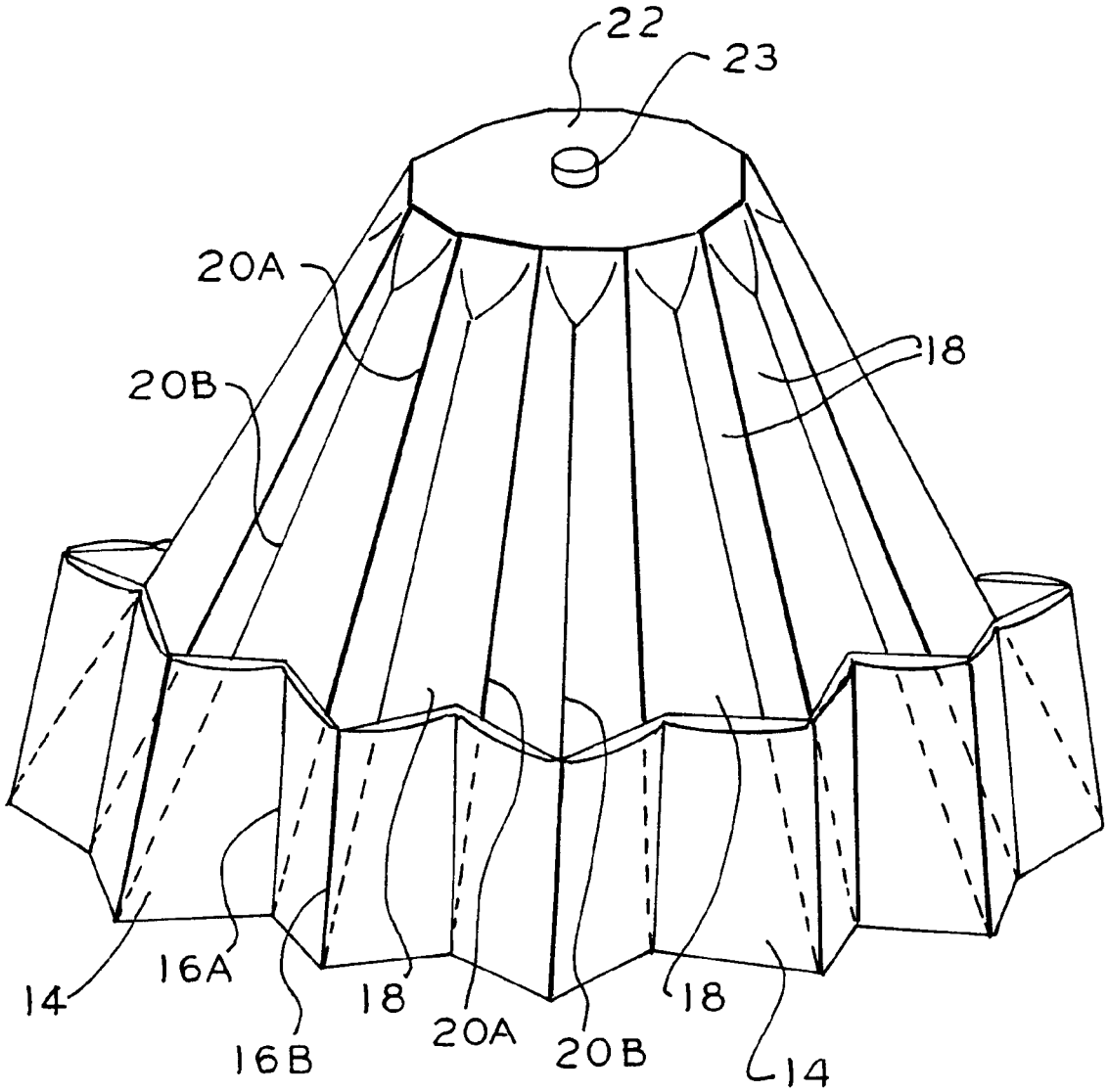
FIG. 5 is a perspective view of the pool of FIG. 1 shown in a partially folded condition.

In some embodiments these grooves can be made wide enough so that they can be contained within the fold; but preferably, folding takes place so that the grooves are on the outside of the fold. In still other embodiments grooves may be formed on both sides of a crease so that the creases can fold in either direction. Depending on the type of relief, the folding relief may be placed on one side, for example, the underside of the floor 12 and the outside of sidewall Referring to FIGS. 5 and 6, central region 22 shown is fitted with an optional drain plug 23. The pool is shown in the process of being folded. Folding may be accomplished by grasping and lifting central region 22, allowing the sectors 18 and the creases 20A and 20B to articulate downwardly as shown in FIG. 5. At the same time, the creases 20A and 20B will fold to form valleys and ridges, respectively. This folding of sectors 18 is similar, but not identical, to the way a conventional umbrella folds. Also at this time, the segments 14 will fold toward the sectors 18, while simultaneously folding along creases 16A and 16B in an accordion-like fashion.

Figure 6:
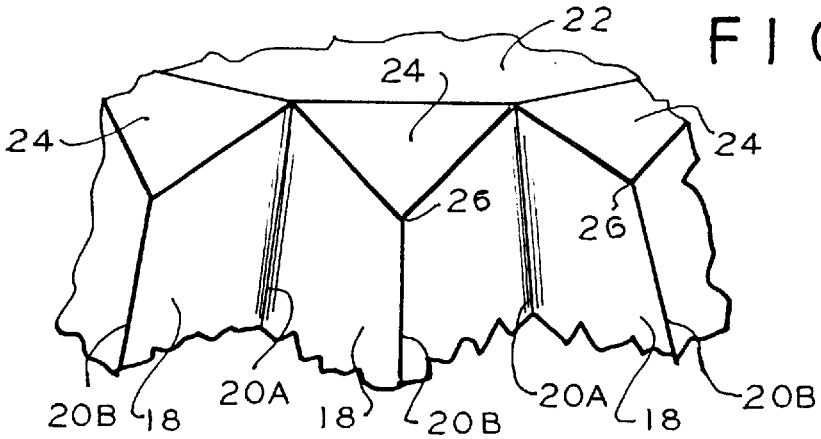
FIG. 6 is a detailed, fragmentary, perspective view of an upper portion of the partially folded pool of FIG. 5.

The articulation of sectors 18 about central region 22 results in the formation of three-sided sections 24, in this embodiment. Each of the sections 24 has a distal vertex 26 opposite its border with central region 22. Vertices 26 are aligned with the ridges formed by creases 20B. The borders of sections 24 can be relieved with grooves to allow a well-defined folding line. Alternatively, the region around each of the sections 24 can be made somewhat thinner to allow a more general folding region with less distinct fold lines. In still other embodiments the sections 24 will maintain a uniform thickness without any special provisions for folding. While sections 24 are shown in FIG. 6 as well-defined triangles, in practical embodiments these sections can have a complex three-dimensional curve with indistinct borders. The transition from section to section may involve a complex, saddle-shaped region with indistinct borders.

Figure 7:
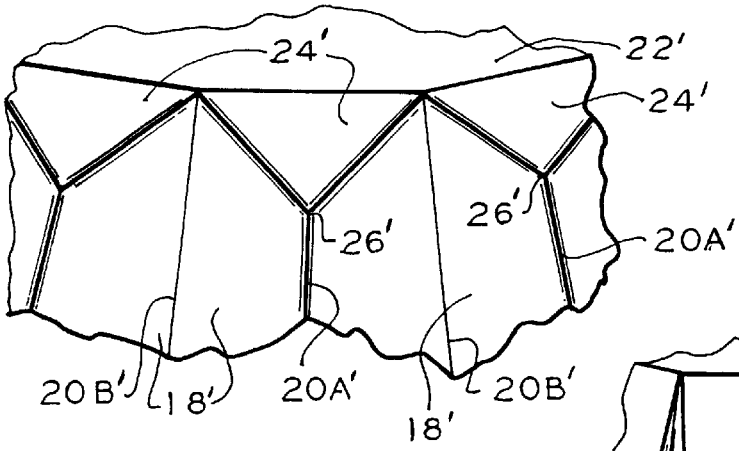
FIG. 7 is a detailed, fragmentary, perspective view of an upper portion of a pool with a folding scheme that is an alternate to that of FIG. 6.

Referring to FIG. 7, components corresponding to those previously illustrated in FIG. 6 have the same reference numerals but are marked with a prime (′). Central region 22′ is bordered with a number of three-sided sections 24′, whose vertices 26′ align with the valleys formed by relieved creases 20A′. These valleys alternate with the ridges formed by relieved creases 20B′. The ridges and valleys form the borders for sectors 18′.

Figure 8:
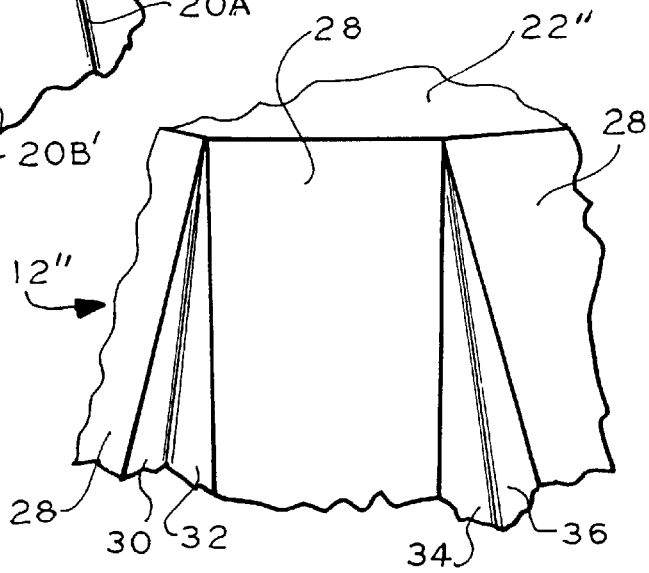
FIG. 8 is a detailed, fragmentary, perspective view of an upper portion of a pool with a folding scheme that is an alternate to that of FIGS. 6 and 7.

Referring to FIG. 8, alternative floor 12″ has a central region 22″ similar to that previously described. The previously mentioned sectors, however, have been replaced with sectors 28 whose outwardly directed sides are parallel (or diverge slightly). Downward articulation of sectors 28 is accommodated by inward pleats 30 and 32. In some embodiments these pleats may be evenly distributed around the central region 22″. In this embodiment, inward pleats 30 and 32 alternate with outward pleats 34 and 36. Other embodiments may use outward pleats 34 and 36 exclusively, which pleats will be evenly distributed around central region 22″.

Figure 9:
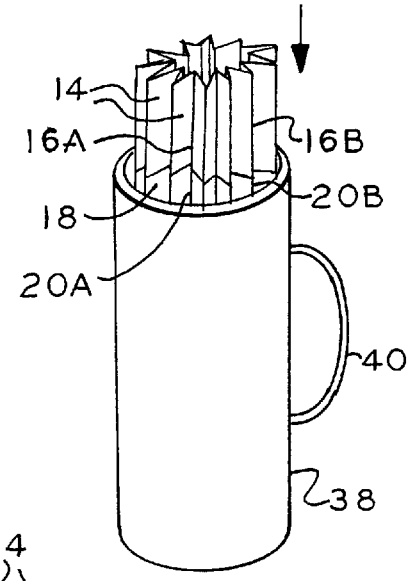
FIG. 9 is a perspective view of the pool of FIG. 5 shown fully folded and partially inserted into a carrier.

In any event, the sectors 18 and segments 14 may be brought together to form the compact package shown in FIG. 9. Preferably, the pool will be held in a folded condition with an elastic band, a tie cord, etc. In this view, the folded pool is loaded into carrier 38 with the central region 22 (not shown in this view) inserted first. Carrier 38 is preferably a waterproof, cylindrical container with a carrying handle 40. The folded pool may be inserted completely into carrier 38 so that no portion of the pool extends outside the carrier. In some embodiments a cover may be provided for carrier 38.

To use the pool one will remove it from the carrier 38 and unfold it to the configuration shown in FIG. 1. The segments 14 are rigid enough that they will not collapse when the pool is filled with water. For beach use one may also build a reinforcing sand bank around the sidewall 10. Alternatively, the pool can be placed inside a matching hole dug in the sand, which may be backfilled if desired. The pool can be filled in various ways. Preferably, water can be carried with the carrier 38.

It is appreciated that various modifications may be implemented with respect to the above described, preferred embodiments. While the illustrated pool has a circular border, some embodiments will have a border that is oval, rectangular, polygonal, etc. Some embodiments will employ a separate reinforcing device, such as a flexible band that attaches to the rim of the pool. Furthermore, the dimensions of the pool can be very depending upon the desired capacity, carrying weight, strength, etc. Moreover, the pool can be fabricated from a variety of plastics, sheet metal, fabrics, and other materials, depending upon the desired strength, rigidity, carrying weight, etc.

Also, while the illustrated pool the shown with 24 folding sectors, in other embodiments the pool may be divided into a different number of folding sectors. In addition, a variety of folding schemes can be implemented. For example, the floor of the pool can be subdivided into one or more annular regions that can be folded against an adjacent inner region.

Obviously, many modifications and variations of the present invention are possible in light of the above teachings. It is therefore to be understood that within the scope of the appended claims, the invention may be practiced otherwise than as specifically described.

What is claimed is:

1. A folding wading pool having in an unfolded condition a floor encompassed by an annular sidewall, said floor having a plurality of lower creases diverging outwardly from a central location toward said sidewall, said sidewall having a spaced plurality of upright creases, said lower and said upright creases being foldable to: (a) contract said sidewall by folding said upright creases, and (b) collapse said floor by (i) articulating said lower creases about said central location, and (ii) swinging said sidewall toward said floor.

2. A folding wading pool according to claim 1 wherein said lower and said upright creases are foldable to: (a) contract the sidewall by folding the upright creases accordion-like, and (b) collapse the floor in an umbrella-like fashion.

3. A folding wading pool according to claim 1 wherein said lower and said upright creases are elastomerically flexible.

4. A folding wading pool according to claim 1 wherein said sidewall and said floor are elastomerically flexible.

5. A folding wading pool according to claim 1 wherein said lower creases are radial.

6. A folding wading pool according to claim 1 wherein said lower creases comprise radial grooves.

7. A folding wading pool according to claim 1 wherein successive ones of said lower creases are relieved on alternating sides of said floor.

8. A folding wading pool according to claim 1 wherein successive ones of said upright creases are relieved on alternating sides of said sidewall.

9. A folding wading pool according to claim 8 wherein successive ones of said lower creases are relieved on alternating sides of said floor, said lower and said upright creases being elastomerically flexible.

10. A folding wading pool according to claim 1 wherein said sidewall comprises a ring of four-sided segments, adjacent ones of the segments being joined along corresponding ones of said upright creases.

11. A folding wading pool according to claim 1 comprising:

a carrier sized to hold said floor and sidewall in a folded condition.

12. A folding wading pool according to claim 11 wherein said carrier has a carrying handle and is adapted to carry water.

13. A folding wading pool according to claim 1 wherein said floor comprises:

a central region containing said central location; and a plurality of successive sectors around, and extending away from, said central region, adjacent ones of said sectors being joined along said lower creases.

14. A folding wading pool according to claim 13 wherein said successive sectors have a plurality of straight proximal borders forming a regular polygon.

15. A folding wading pool according to claim 13 wherein said sectors are foldable into alternating valleys and ridges.

16. A folding wading pool according to claim 15 wherein said central region has on its periphery a plurality of three-sided sections, each having a distal vertex pointing away from said central region.

17. A folding wading pool according to claim 16 wherein said distal vertices are located at said ridges.

18. A folding wading pool according to claim 16 wherein said distal vertices are located at said valleys.

19. A method for folding a wading pool having in an unfolded condition a floor encompassed by an annular sidewall, comprising the steps of:

folding said floor with a plurality of lower creases that diverge outwardly from a central location toward said sidewall; and folding said sidewall with a spaced plurality of upright creases, said lower and said upright creases being folded to: (a) contract said sidewall by folding said upright creases, and (b) collapse said floor by (i) articulating said lower creases about said central location, and (ii) swinging said sidewall toward said floor.

20. A method according to claim 19 wherein said lower and said upright creases are folded to: (a) contract the sidewall by folding the upright creases accordion-like, and (b) collapse the floor in an umbrella-like fashion.

21. A method according to claim 19 wherein said lower creases are radial.

22. A method according to claim 19 wherein the step of folding said sidewall is performed to form a ring of four-sided segments, adjacent ones of the segments being joined along corresponding ones of said upright creases.

23. A method according to claim 19 comprising the step of:

storing said floor and sidewall in a folded condition in a carrier.

24. A method according to claim 23 comprising the steps of:

removing said floor and sidewall from said carrier;

unfolding said floor and sidewall; and carrying water to said floor and sidewall with said carrier.

25. A method according to claim 19 wherein said floor has a central region containing said central location, the step of folding said floor being performed by folding said floor into a plurality of successive sectors around, and extending away from, said central region, adjacent ones of said sectors being joined along said lower creases.

26. A method according to claim 25 wherein said sectors are folded into alternating valleys and ridges.

27. A method according to claim 26 wherein the folding of said floor is performed to surround said central with a plurality of three-sided sections, each having a distal vertex pointing away from said central region.

28. A method according to claim 27 wherein said distal vertices are located at said ridges.

29. A method according to claim 27 wherein said distal vertices are located at said valleys.

* * * * *